US007950516B2

(12) United States Patent
De Leo et al.

(10) Patent No.: US 7,950,516 B2
(45) Date of Patent: May 31, 2011

(54) SYSTEM FOR CONVEYING GROUPS OF PARTIALLY OVERLAPPING POSTAL OBJECTS

(75) Inventors: Guido De Leo, Genoa (IT); Cristiano Franzone, Genoa (IT)

(73) Assignee: Elsag Datamat SpA, Genova (IT)

( * ) Notice: Subject to any disclaimer, the term of this patent is extended or adjusted under 35 U.S.C. 154(b) by 339 days.

(21) Appl. No.: 12/136,385

(22) Filed: Jun. 10, 2008

(65) Prior Publication Data

US 2009/0016858 A1 Jan. 15, 2009

(30) Foreign Application Priority Data

Jun. 13, 2007 (IT) ..... TO2007A0421

(51) Int. Cl.
*B65G 1/06* (2006.01)

(52) U.S. Cl. ..... 198/347.4; 198/369.1; 700/230

(58) Field of Classification Search ..... 414/281–283, 414/271, 222.08, 593; 700/218, 230; 198/347.4, 198/369.2, 369.6, 369.1
See application file for complete search history.

(56) References Cited

U.S. PATENT DOCUMENTS

| | | | | | |
|---|---|---|---|---|---|
| 3,792,785 | A * | 2/1974 | Weir | 414/278 |
| 3,921,828 | A * | 11/1975 | Suizu | 414/280 |
| 4,014,442 | A * | 3/1977 | Adelson et al. | 414/282 |
| 4,856,956 | A * | 8/1989 | Zur | 414/280 |
| 5,174,454 | A * | 12/1992 | Parkander | 209/3.3 |
| 5,178,506 | A * | 1/1993 | Meschi | 414/268 |
| 5,286,157 | A * | 2/1994 | Vainio et al. | 414/273 |
| 5,636,727 | A * | 6/1997 | Neri et al. | 198/574 |
| 7,046,586 | B1 * | 5/2006 | Creager et al. | 369/30.28 |
| 2004/0197172 | A1 * | 10/2004 | Hansl et al. | 414/281 |
| 2005/0095093 | A1 * | 5/2005 | Hansl | 414/277 |
| 2005/0269184 | A1 * | 12/2005 | Enya | 198/369.2 |

FOREIGN PATENT DOCUMENTS

JP 04089701 A * 3/1992 ..... 414/281

* cited by examiner

*Primary Examiner* — Mark A Deuble
(74) *Attorney, Agent, or Firm* — Berenato & White, LLC

(57) ABSTRACT

Conveying system, wherein a conveying device that is mobile with respect to an accumulation device is designed to convey a group of postal objects received at input from a flow-forming device designed to generate at output the group of postal objects aligned in a reference direction, partially overlapping one another and arranged with their own front edges spaced apart from one another. The accumulation device is provided with a plurality of cells, each of which is designed to contain at least one group of postal objects fed to the accumulation device by the translating-lifting device.

17 Claims, 7 Drawing Sheets

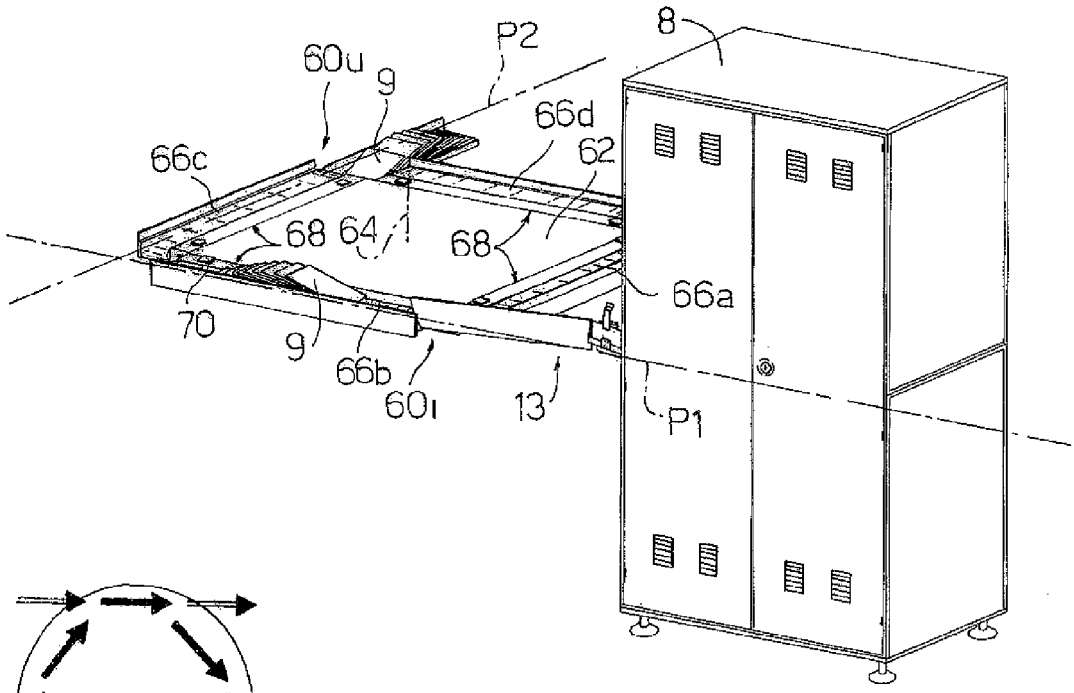
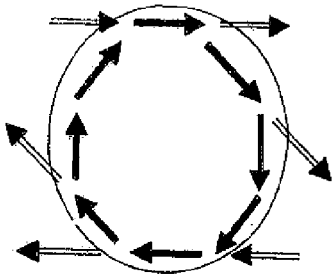
Fig.9
Fig.7
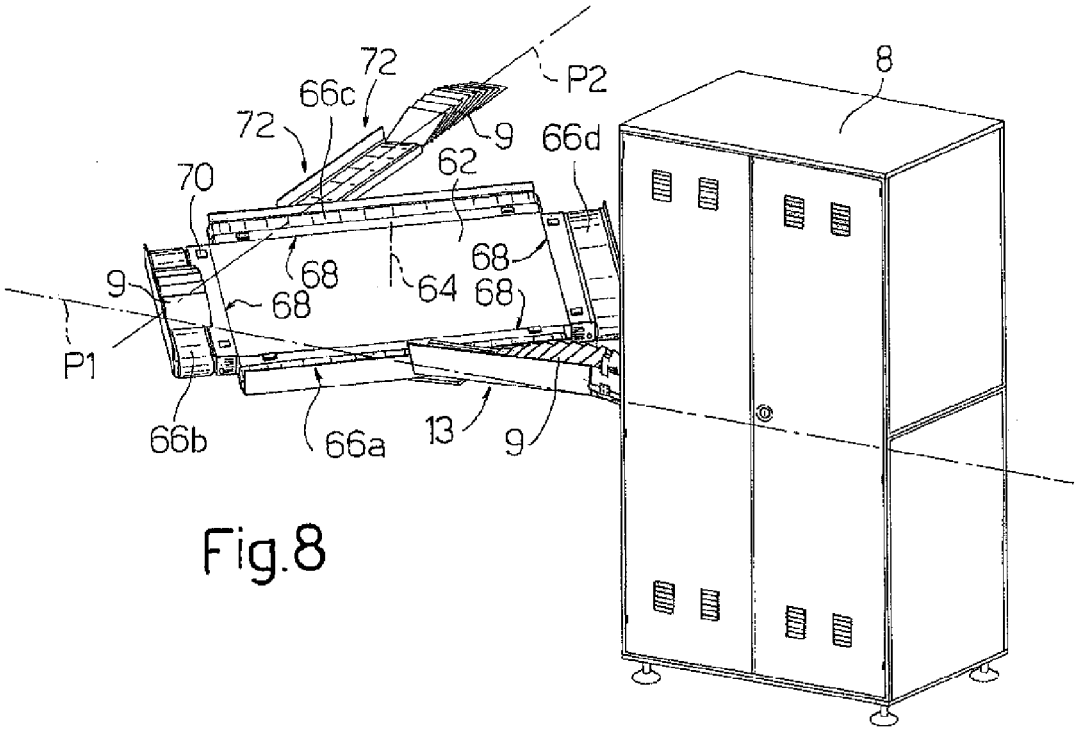
Fig.8

SYSTEM FOR CONVEYING GROUPS OF PARTIALLY OVERLAPPING POSTAL OBJECTS

This application is a US Utility patent application based on Italian Patent Application No. TO2007A 000421 filed Jun. 13, 2007 which is hereby incorporated by reference in it's entirety.

The present invention relates to a system for conveying groups of partially overlapping postal objects.

BACKGROUND OF THE INVENTION

Known to the art are flow-forming devices that receive at input rectangular postal objects, for example postal objects arranged in the form of a pack, and generating at output a group of partially overlapping postal objects, i.e., ones aligned in a rectilinear direction, partially overlapping and arranged with their own front edges (corresponding to a minor side of the rectangular perimeter) appropriately spaced apart from one another, for example with a pitch that is not constant and depends upon the dimensions of the objects set up against one another.

Said flow-forming devices can, in some operating configurations, operate jointly with accumulation devices designed to carry out the operation of accumulation and conveying of the sets of partially overlapping postal objects.

For example, the European patent No. EP-B-923 997 filed in the name of the present applicant describes a device for the conveying and accumulation of groups of partially overlapping postal objects, in which a plurality of first conveying modules receive at input the groups of partially overlapping postal objects generated by flow-forming devices and feed them at output towards a loop conveying system that communicates with inputs of second conveying modules.

The loop conveying system controlled by an electronic control unit is configured to receive a set of partially overlapping postal objects arriving from any first source module and feed it to any second conveying destination module.

SUMMARY OF THE INVENTION

The aim of the present invention is to provide a system for conveying groups of partially overlapping postal objects that will enable an effective management of the groups of partially overlapping objects.

The above aim is achieved by the present invention in so far as it relates to a system for conveying groups of partially overlapping postal objects of the type as claimed in the attached Claims.

BRIEF DESCRIPTION OF THE DRAWINGS

The invention will now be illustrated with particular reference to the attached figures, which illustrate a preferred non-limiting embodiment thereof and in which:

FIGS. 7 and 8 illustrate a first variant to the conveying system of the present invention;

FIG. 9 is a schematic illustration of a further variant of the conveying system according to the present invention.

DETAILED DESCRIPTION OF THE INVENTION

Figure 1:
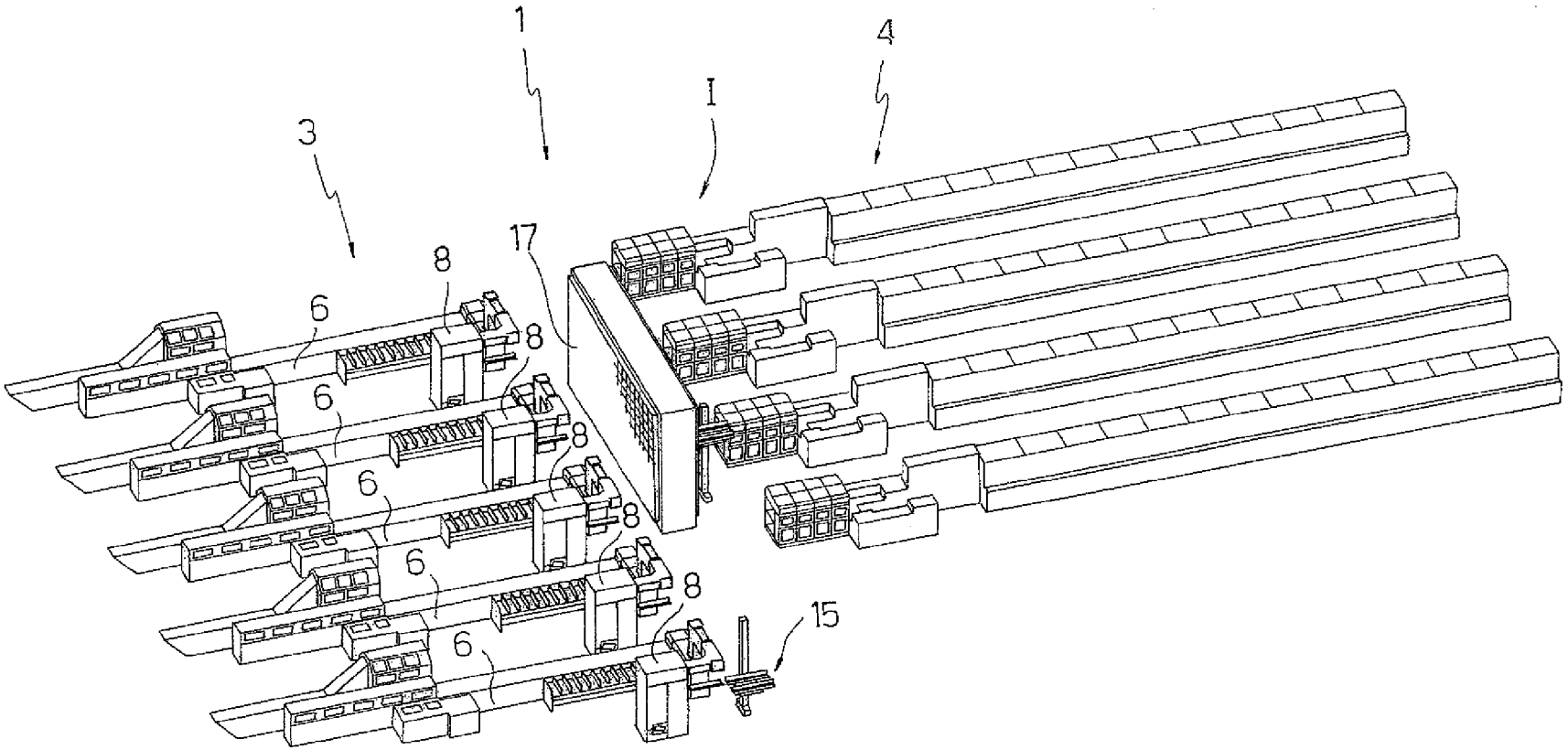
FIG. 1 illustrates, in an overall perspective view, a system for conveying groups of partially overlapping postal objects built according to the dictates of the present invention.

With particular reference to FIG. 1, designated as a whole by 1 is a system for conveying groups of partially overlapping postal objects.

The system 1, in the example of embodiment illustrated, is set between a first postal machine 3 (for example, a letter-coding line) and a second postal machine 4 (for example a letter-final-sorting line) and enables conveying and accumulation of groups of partially overlapping postal objects between the first postal machine 3 and the second postal machine 4.

Figure 2:
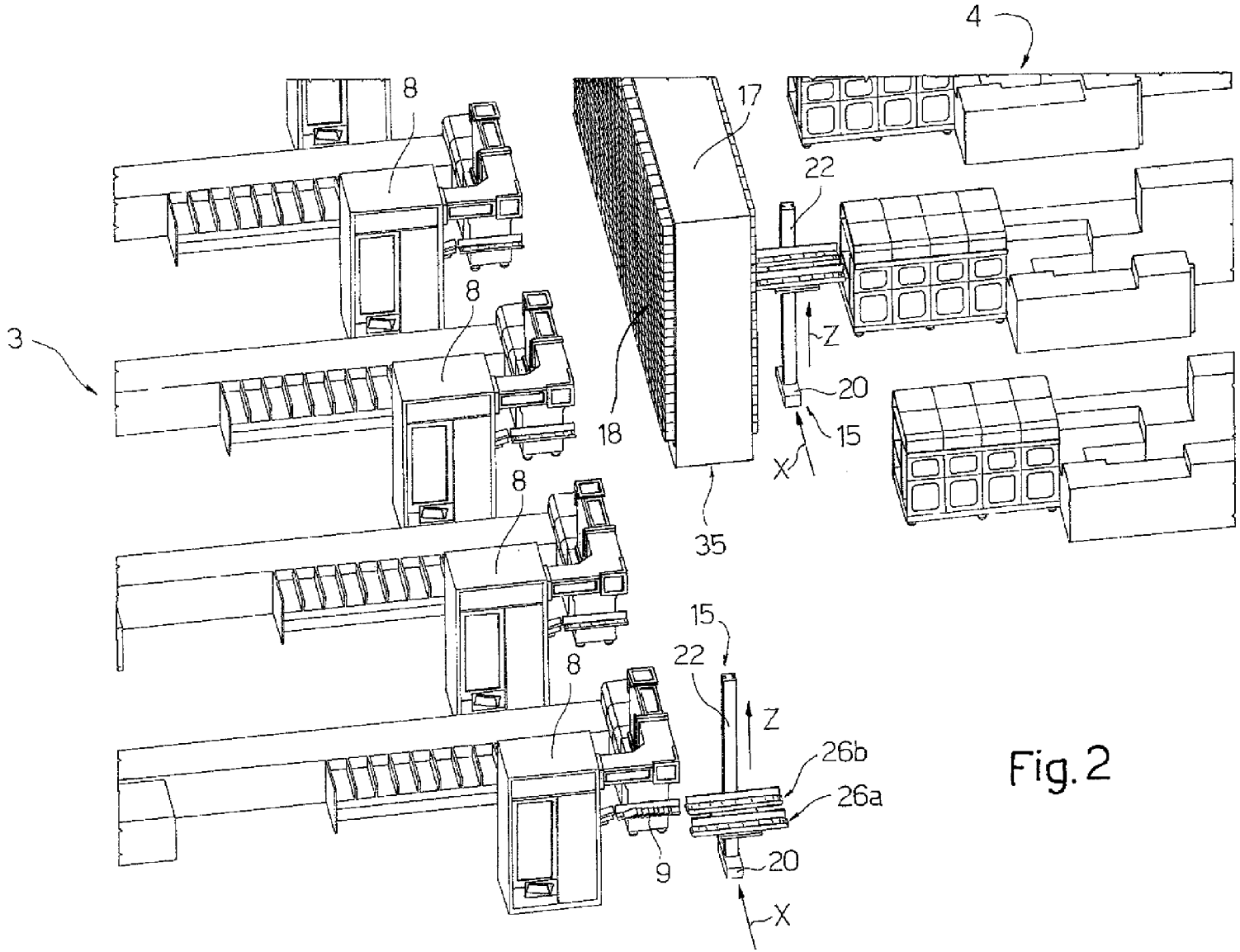
FIG. 2 illustrates, in perspective view and at an enlarged scale, a detail of the system of FIG. 1.

The first postal machine 3 comprises a plurality of postal processing lines 6 (five in the example illustrated) at the end of each of which is set a flow-forming device 8 (of a known type), designed to generate at output a group 9 (FIG. 3) of partially overlapping postal objects (FIGS. 2 and 3), i.e., aligned in a rectilinear direction, partially overlapping one another and arranged with their own front edges (corresponding to a minor side of the rectangular perimeter), appropriately spaced apart from one another, for example with a pitch that is not constant and depends upon the dimensions of the objects set up against one another.

The flow-forming device 8 is housed within a parallelepipedal container 10, provided (FIG. 3), on one side thereof, with a rectangular window 12, from which a stretch of conveyor belt 13 exits, designed to feed at output a group 9 of partially overlapping postal objects.

The conveying system 1 according to the present invention comprises at least one mobile device, for example a translating-lifting device 15 that is mobile in a three-dimensional space and is designed to convey in the three-dimensional space a group (or a number of groups) 9 of postal objects received at input from a flow-forming device 8. The conveying system 1 can moreover comprise an accumulation device 17 (FIGS. 1 and 2) provided with a plurality of cells 18 designed to contain groups of postal objects fed to the accumulation device 17 by the translating-lifting device 15. In greater detail, the translating-lifting device 15 (FIG. 3) comprises a parallelepipedal base structure 20 that is mobile with linear motion in a first, horizontal, direction X, and a vertical upright 22, which extends in a perpendicular direction from the base structure 20 and carries a slide 24 that is mobile in a vertical direction Z in opposite directions under the thrust of motor means (not illustrated).

The slide 24 comprises a rectangular resting surface 25, which is mobile—with limited and alternating directions of travel —in a second, horizontal, direction Y. The resting surface 25 conveys a first and a belt-conveyor device **26*a* second belt-conveyor device 26*b***, arranged parallel to one another and having the same structure.

The translating-lifting device 15 with two belt conveyors **26*a*, 26*b*** is obviously just one example in so far as different configurations are possible, for example provided with one or four belt conveyors.

In particular, each belt-conveyor device **26*a*, 26*b* (FIG. 3) comprises a plane horizontal rectangular structure 28 provided with a plane vertical rectangular side wall 29 that extends along a first major side of the rectangular structure 28; the rectangular structure 28 carries a belt 31, which extends between two return rollers (not illustrated, one of the two return rollers is motor-driven) arranged at end portions 28***a*, 28*b* of the rectangular structure 28.

The belt 31 thus defines a plane resting surface, which extends from a first roller (input of the belt 31) to an opposite roller (output of the belt 31).

The rectangular structure 28 carries at its end portions 28*a*, 28*b* a first photocell 32*a* and a second photocell 32*b*, designed to detect the presence of end portions of a group 9 of partially overlapping postal objects arranged on the plane surface of the belt 31.

The belt 31 is mobile, with opposite directions of advance, under the thrust of an electric motor (not illustrated) carried by the slide 24.

The base structure 20 is moreover preferably mobile along a rail (not illustrated), which extends in the area comprised between the end (FIG. 2) of the first postal machine 3 and a side of the accumulation device 17.

The accumulation device 17 is housed in an external casing 35 which has a parallelepipedal shape and defines inside it the cells 18 that are arranged according to an orderly matrix structure. All the cells 18 moreover have the same structure and the same dimensions.

Figure 4:
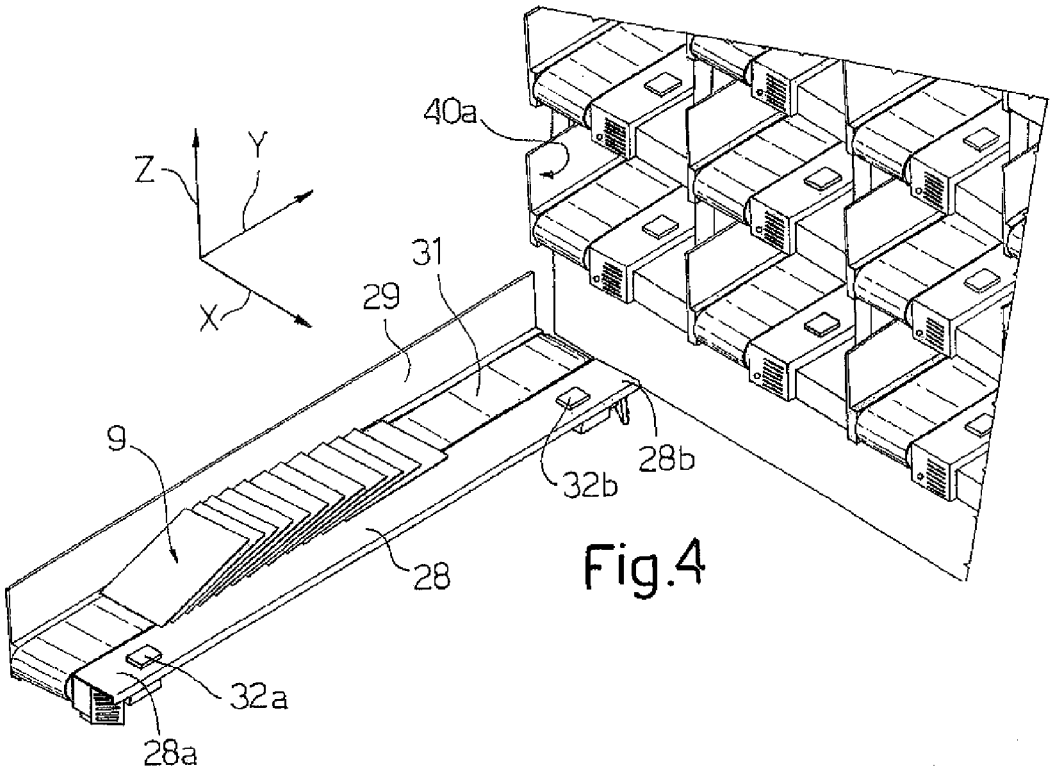
FIGS. 4 and 5 illustrate operations of coupling between parts of the system of the present invention.

In particular, each cell 18 (FIGS. 4 and 5) defines a parallelepipedal through cavity 36, a base wall of which is delimited, at least partially, by the plane portion 38*a* of a conveyor belt 38, which extends throughout the length of the parallelepipedal through cavity.

In particular, the conveyor belt 38 extends between a first end roller 39, set in the proximity of a first front opening 40*a* of the cell 18 and a second end roller (not illustrated), set in the proximity of a second rear opening (not illustrated) of the cell 18.

In this way, the front and rear openings 40*a* of the cell 18 open on opposite faces of the parallelepipedal casing 35.

Figure 3:
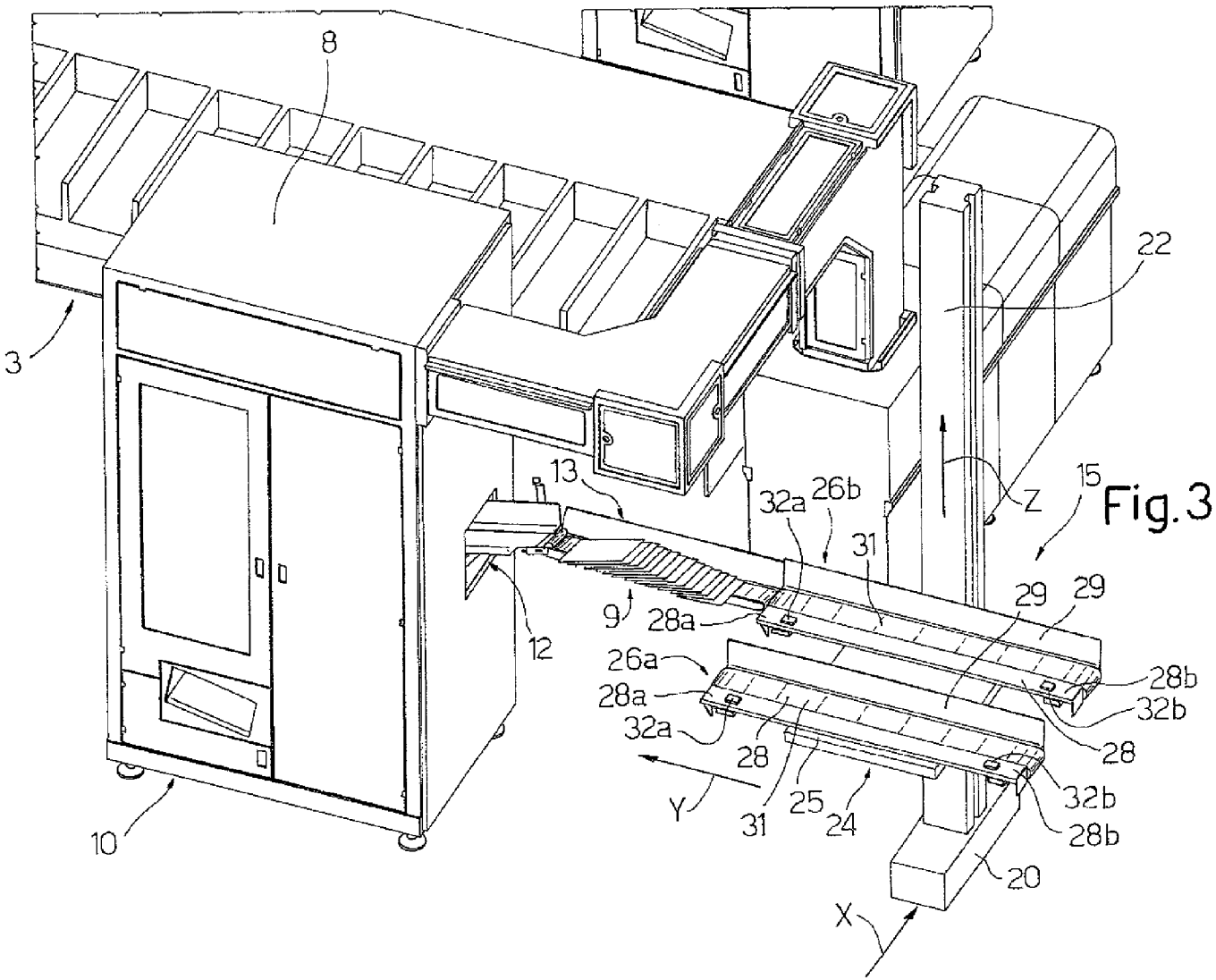
FIG. 3 illustrates, in perspective view and at an enlarged scale, a detail of the system of FIG. 2.

In use, to perform loading of a group of postal objects on the translating-lifting device 15, the latter moves in the direction X until it sets itself substantially facing a flow-forming device 8 (FIG. 3).

A displacement of the slide 24 in the direction Z is moreover made in such a way that one of the two belt-conveyor devices 26*a*, 26*b* (the device 26*b* in the example illustrated) sets itself with the input of the belt 31 facing and communicating with the end portion of the belt 13.

The end portion of the belt 13 and a first end portion of the belt 31 are set alongside one another at a short distance apart by displacing the slide 24 in the direction Y and thus adjusting the distance between the flow-forming device and the belt 31.

Usually, a small misalignment is provided between the two belts 13, 31 to provide for a small drop of the postal objects from the belt 13 towards the next belt 31, preventing the flexibility of the post from bringing the front of the first letter underneath the conveying surface of the next belt.

The belts 13 and 31 then move with concordant directions and at the same speeds in such a way that at least one group of postal objects 9 is displaced from the belt 13 to the belt 31.

The input of the group 9 of postal objects on the belt 31 is detected by the first end photocell 32*a*; in addition, when the second end photocell 32*b* detects a front edge of the group 9 of postal objects, the motion of the belt 31 is interrupted in so far as the translating-lifting device 15 is considered loaded.

The motion of the belt 31 can also be interrupted when the photocell 32*a* no longer detects the presence of postal objects; in this case, the photocell 32*b* is used as further control.

The translating-lifting device 15 then moves in the direction X, moving away from the flow-forming device 8 previously selected and approaching the accumulation device 17.

The selection of a pre-set destination cell cell 18 of the accumulation device 17 is made (FIGS. 4 and 5) by adjusting the position of the translating-lifting device 15 with respect to the accumulation device 17 in the direction X and adjusting the height of the conveyor belt 31 with respect to the base structure 20, i.e., causing the slide 24 to slide in the direction Z.

The motion along the axis Z generally occurs simultaneously with the movement along the axis X.

Figure 5:
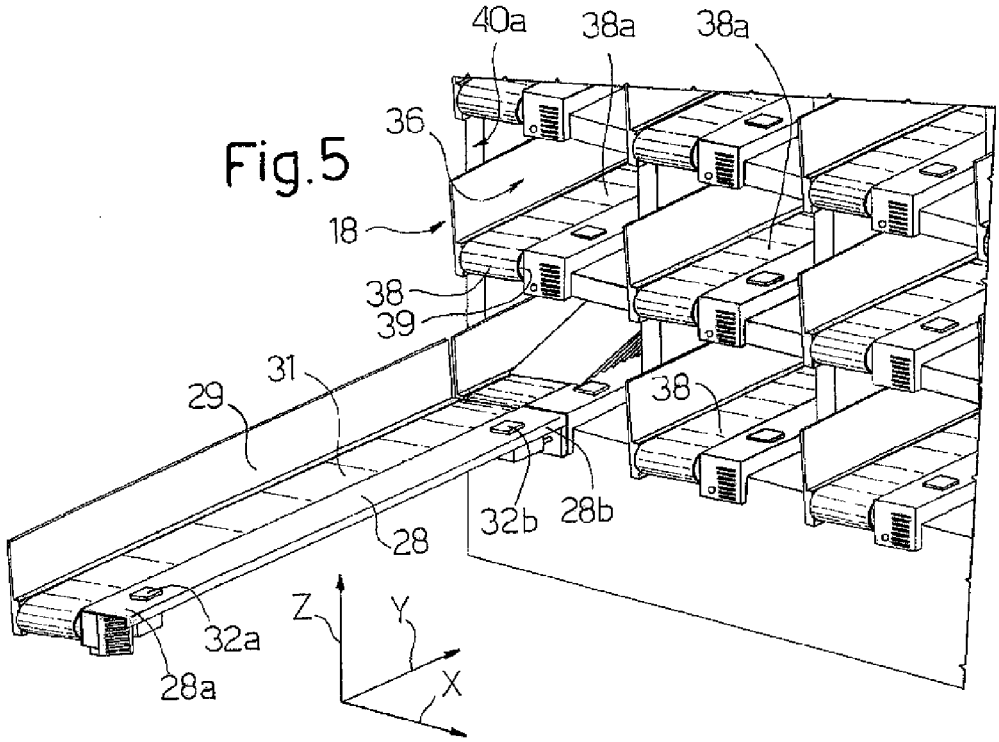

In this way, one end of the belt 31 is set facing the front opening of the cell 18 selected (FIG. 5).

The end portion of the belt 38 and a second end portion of the belt 31 are set alongside one another at a short distance apart by displacing the slide 24 in the direction Y and thus adjusting the distance between the accumulation device 17 and the belt 31.

Usually, a small misalignment is provided between the two belts 31, 38 to provide for a small drop of the postal objects from the belt 31 towards the next belt 38, preventing the flexibility of the post from bringing the front of the first letter underneath the conveying surface of the next belt.

The belts 31 and 38 then move with concordant directions and at the same speeds in such a way that the group of postal objects 9 loaded on the translating-lifting device 15 is displaced from the belt 31 to the belt 38, penetrating into the cell 18 (FIG. 5).

The motion of the conveyor belt 38 continues until all the postal objects previously supported by the translating-lifting device 15 set themselves within the cell 18; when said condition is reached, the belts 31 and 38 terminate their motion in so far as the group of postal objects 9 is now completely contained within the cell 18. There are thus completed the operations of unloading of the postal objects by the translating-lifting device 15 and their loading within the cell 18 selected.

The translating-lifting device 15 then moves away from the cell 18 previously selected and moves towards a flow-forming device 8 to execute a new operation of loading with the modalities previously described. The repetition of the operations previously described enables loading of different groups of postal objects within different cells 18 of the accumulation device 17.

In addition, both of the belt-conveying devices 26*a*, 26*b* can be loaded with respective groups 9 of postal objects; unloading of said first and second groups of postal objects can be performed in parallel by coupling the output of the belts 31 belonging to the belt-conveying device 26*a*, 26*b* with respective first and second cells 18 adjacent to one another or else by filling non-adjacent cells in succession.

Unloading of the group 9 of postal objects contained within a cell 18 can be performed from the front opening 40*a* or from the rear opening 40*b* with operations that are perfectly analogous.

In the ensuing description, reference will be made to unloading of the groups of postal objects through the rear opening (not illustrated) and their loading on a translating-lifting device 15 (FIG. 2), which moves in the direction X in an area of the space comprised between the accumulation device 17 and the second postal machine 4.

In other words, translating-lifting devices 15 are used (in FIG. 2 two are illustrated by way of example), which move along paths set facing opposite faces of the accumulation device 17.

Selection of a pre-set cell 18 of the accumulation device 17 to be unloaded is made by adjusting the position of the translating-lifting device 15 with respect to the accumulation device 17 in the direction X and adjusting the height of the conveyor belt 31 with respect to the base structure 20, i.e., causing the slide 24 to slide in the direction Z.

In this way, one end of the belt 31 is set facing the rear opening 40*b* of the cell 18 selected.

The end portion of the belt 38 and an end portion of the belt 31 are set alongside one another at a short distance apart, by displacing the slide 24 in the direction Y and thus adjusting the distance between the accumulation device 17 and the belt 31.

The belts 31 and 38 then move with concordant directions and at the same speeds in such a way that the group of postal objects 9 housed within the cell 18 is displaced towards the translating-lifting device 15, setting itself on the belt 31.

The motion of the conveyor belt 38 continues until all the postal objects previously housed in the cell 18 are displaced on the belt 31 of the translating-lifting device 15; when said condition is reached, the belts 31 and 38 terminate their motion in so far as the group of postal objects 9 is now carried by the translating-lifting device 15.

The translating-lifting device 15 then moves away from the cell 18 previously unloaded and moves towards the second postal machine 6. The repetition of the operations previously described enables different groups of postal objects to be unloaded from different cells 18 of the accumulation device 17.

Figure 6:
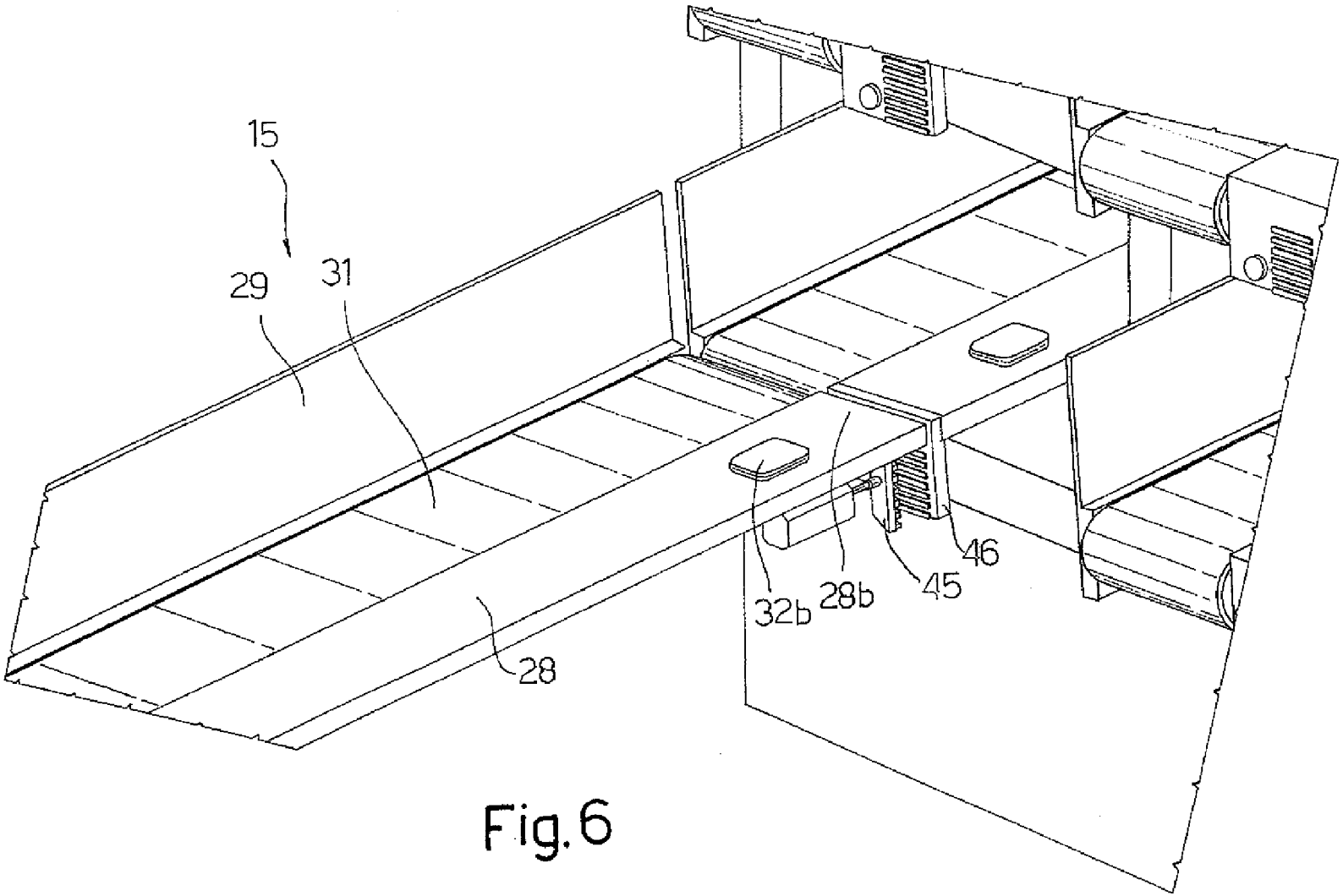
FIG. 6 illustrates, at an enlarged scale, a detail of FIG. 5.

The translating-lifting device 15 is provided with a first electrical connector 45 (FIG. 6) set in the proximity of the end portion 28*b* of the wall 28 underneath the belt 31 whilst each cell 18 is provided with a second connector 46 complementary to the first, facing the outside of the casing 35 and designed to be coupled to the connector 46.

The first electrical connector 45 is connected to an electrical-power supply line (not illustrated) and is designed to be coupled to the second electrical connector 46 when the translating-lifting device 15 is coupled (FIG. 6) with a cell 18 to carry out unloading of the group of postal objects 9 towards the cell or unloading of the postal objects contained in the cell 18 towards the translating-lifting device 15 according to what was set forth previously.

The electrical connectors 45 and 46 coupled to one another and set in the closed condition enable transit of the electrical-power supply from the translating-lifting device 15 to an electric motor (not illustrated) that supplies the belt 38 of the respective cell 18.

The electrical wiring is thus simplified in so far as each electric motor of each cell 18 does not require a dedicated electrical-power supply line that develops through an accumulation device 17.

In other words, all the electric motors of the different cells 18 are supplied by the same electrical-power supply line that extends through the translating-lifting device 15.

Figure 10:
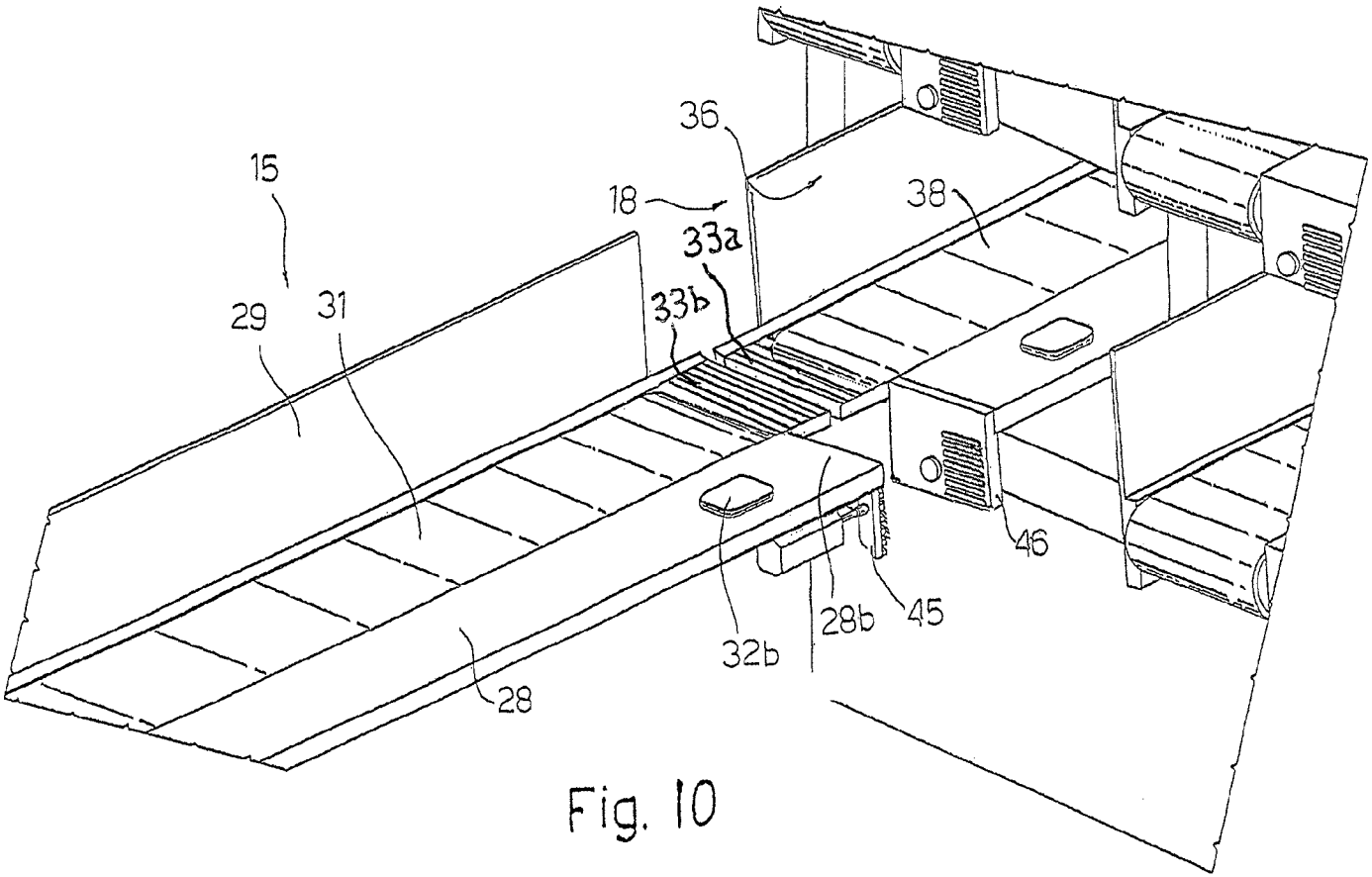
FIG. 10 illustrates, at an enlarged scale, means for mechanical transmission between an accumulation device and a translating-lifting device.

Alternatively, as illustrated in FIG. 10 there may be envisaged a mechanical transmission formed by first parts 33*a* carried by the accumulation device 17 and second parts 33*b* carried by the translating-lifting device 15. The first and second parts are coupled to one another in the position of coupling for unloading in order to transmit the motion mechanically from the translating-lifting device to the cell selected 18 for moving the conveyor belt 38 and moving the group of postal objects in the cell 18.

Illustrated in FIGS. 7 and 8 is a rotating device 60 designed to replace or integrate the functions performed by the translating-lifting device 15.

The rotating device 60 is designed to receive on an input 60*i* thereof a group of postal objects 9 arriving in a first rectilinear direction of advance P1 and is designed to modify the direction of advance of said group of postal objects 9 supplying to an output 60*u* thereof the group of postal objects in a second rectilinear direction of advance P2 transverse to the first.

Preferably the first and second directions of advance P1 and P2 form an angle of 90° with respect to one another.

The rotating device 60 can be set between:

- an output of the flow-forming device 8 and an input of the accumulation device 17 (according to said embodiment the rotating device 60 performs the functions of movement of the translating-lifting device 15 that is not present);
- an output of the flow-forming device 8 and a prosecution of the flow-forming device 8 (not illustrated);
- an output of the flow-forming device 8 and an input I of one of the sorting devices illustrated in FIG. 1;
- an output of the flow-forming device 8 and the translating-lifting device 15 (according to said embodiment the rotating device 60 co-operates with the translating-lifting device 15 that is present).

The rotating device 60 has at least one input and at least one output; according to an embodiment illustrated schematically in FIG. 9, the rotating device 60 has one or more inputs and one or more outputs 60*u*_1, 60*u*_1, . . . 60*u*_i, . . . 60*u*_n, which communicate with conveying devices located downstream, for example translating-lifting devices 15 or devices for conveying and interface with the sorting lines (not numbered in FIG. 1).

The rotating device 60 comprises a rotating element 62, which is angularly mobile about a vertical axis 64 and carries at least one rectilinear belt conveyor 66, which has an input 76*a* and an output 76*b*.

The rotating element 62 is angularly mobile between at least one loading position (FIG. 7), in which the conveyor belt 66 is aligned with the first rectilinear direction P1 and the input 76*a* is communicating with an output of the flow-forming device (conveyor belt 13), and an unloading position (FIG. 7), in which the conveyor belt 66 is aligned with the second rectilinear direction P2 and the input 76*b* is communicating with a subsequent device to which the group 9 of postal objects is fed.

In the embodiment illustrated in FIGS. 7 and 8, the rotating element 62 has a square shape in plan view and defines four rectilinear sides 68, extending along which are respective rectilinear belts 66*a*, 66*b*, 66*c* and 66*d*.

In particular, each belt 66 has the same length as the side 68 and is carried by a structure that extends in cantilever fashion along the side 68.

The belt 66 is moreover associated to a rectangular side element facing the outside of the rotating element and extending throughout the length of the belt 66.

In the loading position, one of the belts (in the example, the belt 66*b*) sets itself parallel to the direction P1 with an input 67*a* set facing an output of the conveyor belt 13, which is located in a higher position with respect to the belt 66*b* so as not to interfere with the rotation of the rotating element 62.

The postal objects arranged in the group 9 are released from the belt 13 and proceed on the belt 66*b*, which sets itself immediately in motion, displacing the postal objects from the input 67*a* to the output 67*b*. The motion of the postal objects along the belt 66*b* terminates when a front edge of the group 9 of objects is intercepted by a photocell 70.

The rotating element 62 turns then through 90° under the thrust of an electric motor (not illustrated) and carries the belt

66*b* aligned with the direction P2, with the output 76*b* facing a conveyor belt 72 set underneath the belt 66*b* so as not to interfere with the rotation of the rotating element 62.

The motion of the conveyor belt 66*b* then resumes for unloading the postal objects present on the belt 66*b* onto the belt 72; the completion of unloading of the postal objects is detected by the photocell 70, which that detects a rear edge of the group of postal objects at output. Similar operations are performed for loading and unloading the belts 66*a*, 66*c* and 66*d*.

Generically, the rotating element 62 could comprise any number of rectilinear conveyor belts 66 (for example, two, three, six, eight, etc.), each of which defining a respective input and a respective output.

In this case, the rotating element 62 would be angularly mobile between a plurality of angular positions of loading and unloading.

In the positions of loading, at least part of the conveyor belts are aligned in a plurality of directions of loading, and at least part of the conveyor belts are aligned in positions of unloading.

In the positions of unloading, at least part of the conveyor belts are aligned in a plurality of directions of unloading and at least part of the conveyor belts are aligned in positions of loading.

The invention claimed is:

1. A conveying system comprising:

a mobile conveying device (15) provided to convey at least one group (9) of postal objects received at input from flow-forming means (8), said mobile conveying device comprises a translating-lifting device (15);

an accumulation device (17) having a plurality of cells (18), each of said cells adapted to contain said at least one group of postal objects (9) fed to said accumulation device (17) by said conveying device (15);

said flow-forming means (8) provided to generate at output said group (9) of postal objects aligned in a reference direction, partially overlapping one another and arranged so that front edges of said postal objects spaced apart from one another;

said translating-lifting device (15) provided with at least one motor-driven belt (31) to receive at input said at least one group of postal objects fed by said flow-forming means (8) and to feed at output said at least one group of postal objects towards an input of one of said cells (18);

said translating -lifting device (15) being mobile between at least one loading position, in which said translating-lifting device (15) is functionally coupled with said flow-forming means (8) to receive said at least one group of postal objects on said belt (31), and an unloading position, in which said translating-lifting device (15) is functionally coupled with said accumulation device (17) for the feed of said at least one group of postal objects towards a selected cell (18);

said conveying system further comprising transmission means for mechanical transmission between said accumulation device and said translating-lifting device when said translating-lifting device is coupled to said accumulation device in the unloading position;

said transmission means provided to transmit the motion mechanically from said translating-lifting device to the selected cell (18) for moving said group of postal objects within said cell (18) in said unloading position.

2. The conveying system according to claim 1, wherein said motor-driven belt (31) is carried by a slide (24) that is mobile with alternating directions under the thrust of motor means in a first, vertical, direction (Z).

3. The conveying system according to claim 2, wherein said slide (24) is mobile with alternating directions in a second, horizontal, direction (Y) transverse to the first direction (Z) to perform a recession/approach of an end portion of said belt (31) from/to:

an output (13) of said flow-forming means (8); or the input (40*a*, 40*b*) of a said cell.

4. The conveying system according to claim 1, wherein said plurality of cells (18) are arranged according to an orderly matrix structure.

5. The conveying system according to claim 4, wherein said cells (18) have the same structure and the same dimensions.

6. The conveying system according to claim 1, wherein said conveying device comprises at least one rotating device (60), designed to receive at input a group of postal objects (9) arriving in a first rectilinear direction of advance (P1) and designed to modify the direction of advance of said group of postal objects (9) feeding at output the group of postal objects in a second different rectilinear direction of advance (P2) intersecting said first direction.

7. The conveying system according to claim 6, wherein the first and second directions of advance (P1, P2) form with one another an angle that is 90°.

8. The conveying system according to claim 7, wherein said rotating device (60) has at least one input and a plurality of outputs (60*u*_1, 60*u*_1, . . . 60*u*_i, . . . 60*u*_n).

9. The conveying system according to claim 6, wherein said rotating device (60) comprises a rotating element (62) that is angularly mobile under the thrust of motor means about a vertical axis (64) and carries at least one rectilinear belt conveyor (66), which defines an input (76*a*) and an output (76*b*);

said rotating element (62) being angularly mobile between at least one loading position, in which said conveyor belt (66) is aligned with said first rectilinear direction (P1) and an unloading position, in which the conveyor belt (66) is aligned with said second rectilinear direction (P2).

10. The conveying system according to claim 9, wherein said rotating element (62) comprises a plurality of rectilinear conveyor belts (66) defining a plurality of inputs (76*a*) and outputs (76*b*);

said rotating element (62) being angularly mobile between positions of loading and unloading, in which at least part of said conveyor belts (66) are simultaneously aligned in a plurality of directions and positions of loading and unloading.

11. A conveying system comprising:

a mobile conveying device (15) provided to convey at least one group (9) of postal objects received at input from a flow-fowling device (8), said mobile conveying device comprises a translating-lifting device (15);

an accumulation device (17) having a plurality of cells (18), each of said cells adapted to contain said at least one group of postal objects (9) fed to said accumulation device (17) by said mobile conveying device (15);

each cell (18) defining a through cavity (36) including a base wall delimited, at least partially, by a plane portion (38*a*) of a conveyor belt (38) that extends throughout the length of said through cavity (36);

said flow-forming means (8) provided to generate at output said group (9) of postal objects aligned in a rectilinear reference direction, partially overlapping one another and arranged so that front edges of said postal objects spaced apart from one another;

said translating-lifting device (15) provided with at least one motor-driven belt (31) to receive at input said at least one group of postal objects fed by said flow-forming means (8) and to feed at output said at least one group of postal objects towards an input of one of said cells (18);

said translating-lifting device (15) being movable in a rectilinear direction between at least one loading position, in which said translating-lifting device (15) is functionally coupled with said flow-forming means (8) to receive said at least one group of postal objects on said belt (31), and an unloading position, in which said translating-lifting device (15) is functionally coupled with said accumulation device (17) for the feed of said at least one group of postal objects towards a selected cell (18);

said conveying device conveying said postal objects from said flow-forming means (8) to one of said cells of said accumulation device (17) in three mutually orthogonal rectilinear directions;

said at least one group (9) of postal objects conveyed by said mobile conveying device (15) and received by one of said cells of said accumulation device (17) being aligned in the rectilinear reference direction, partially overlapping one another and arranged so that the front edges of said postal objects spaced apart from one another.

12. The conveying system according to claim 11, wherein said conveyor belt (38) extends between a first end element set in the proximity of a first front opening (40*a*) of the cell (18) and an end element set in the proximity of a second rear opening of the cell (18).

13. The conveying system according to claim 11, wherein said conveyor belt (38) of said cell and the motor-driven belt (31) of said translating-lifting device (15) are actuated with concordant directions and substantially equal speeds for unloading said group of postal objects from said translating-lifting device (15) and introducing it inside said cell (18).

14. The conveying system according to claim 11, wherein said conveyor belt (38) of said cell and the motor-driven belt (31) of said translating-lifting device (15) are actuated with concordant directions and substantially equal speeds for unloading said group of postal objects from said cell (18) and transferring it to said translating-lifting device (15).

15. A conveying system comprising:

a mobile conveying device (15) provided to convey at least one group (9) of postal objects received at input from flow-forming means (8), said mobile conveying device comprises a translating-lifting device (15);

an accumulation device (17) having a plurality of cells (18), each of said cells comprising said at least one group of postal objects (9) fed to said accumulation device (17) by said conveying device (15); and first (45) and second means (46) provided for electrical connection between said translating-lifting device (15) and each of said cells (18);

said flow-forming means (8) provided to generate at output said group (9) of postal objects aligned in a reference direction, partially overlapping one another and arranged so that front edges of said postal objects spaced apart from one another;

each of said cells (18) defining a through cavity (36) such that a base wall of said cavity being delimited, at least partially, by a plane portion (38*a*) of a conveyor belt (38) extending throughout the length of said through cavity (36);

said first and second electrical-connection means (45, 46) coupling in the closed condition when said translating-lifting device is coupled to one of said cells for unloading said at least one group of postal objects towards said one of said cells or unloading said postal objects contained in said one of said cells towards said translating-lifting device (15);

said first and second electrical connection means set in the closed condition enabling transit of an electrical supply from said translating-lifting device (15) to an electric motor that drives said belt (38).

16. A conveying system comprising:

mobile conveying device (15) provided to convey at least one group (9) of postal objects received at input from flow-forming means (8);

said flow-forming means (8) provided to generate at output said group(9) of postal objects aligned in a reference direction partially overlapping one another and arranged so that front edges of said postal objects spaced apart from one another;

said conveying device comprising at least one rotating device (60) receiving at input said at least one group of postal objects (9) arriving in a first rectilinear direction of advance (P1) and modifying the direction of advance of said at least one group of postal objects (9) feeding at output said at least one group of postal objects in a second different rectilinear direction of advance (P2), said second direction being transverse with respect to said first direction;

said rotating device (60) comprising a rotating element (62) angularly mobile under the thrust of motor means about a vertical axis (64) and carrying at least one rectilinear belt conveyor (66) defining an input (76*a*) and an output (76*b*);

said rotating element (62) being angularly mobile between at least one loading position, in which said conveyor belt (66) is aligned with said first rectilinear direction (P1) and an unloading position, in which the conveyor belt (66) is aligned with said second rectilinear direction (P2);

said rotating element (62) having a square shape in plan view and defining four rectilinear sides (68) extending along which are respective rectilinear conveyor belts (66*a*, 66*b*, 66*c* and 66*d*).

17. The conveying system according to claim 16, wherein each conveyor belt (66*a*, 66*b*, 66*c*, 66*d*) has the same length as the side (68) and is carried by a structure that extends in cantilever fashion along the side (68).

* * * * *